US012091271B2

(12) United States Patent
Sundermann et al.

(10) Patent No.: US 12,091,271 B2
(45) Date of Patent: Sep. 17, 2024

(54) SLEEVE, WINDING DEVICE, AND METHOD FOR REPEATED, SUCCESSIVE WINDING OF WEBS TO FORM REELS OF MATERIAL

(71) Applicant: Windmöller & Hölscher KG, Lengerich (DE)

(72) Inventors: Fabian Sundermann, Lengerich (DE); Frank Hoffmann, Lengerich (DE); Ralf Menke, Lengerich (DE)

(73) Assignee: Windmöller & Hölscher KG, Lengerich (DE)

( * ) Notice: Subject to any disclaimer, the term of this patent is extended or adjusted under 35 U.S.C. 154(b) by 968 days.

(21) Appl. No.: 17/057,597

(22) PCT Filed: May 24, 2019

(86) PCT No.: PCT/EP2019/063511
§ 371 (c)(1),
(2) Date: May 27, 2021

(87) PCT Pub. No.: WO2019/224370
PCT Pub. Date: Nov. 28, 2019

(65) Prior Publication Data

US 2021/0380362 A1 Dec. 9, 2021

(30) Foreign Application Priority Data

May 24, 2018 (DE) ..... 10 2018 208 221.9

(51) Int. Cl.
*B65H 19/30* (2006.01)
*B65H 75/24* (2006.01)

(52) U.S. Cl.
CPC ..... *B65H 19/30* (2013.01); *B65H 75/24* (2013.01); *B65H 75/2437* (2021.05);
(Continued)

(58) Field of Classification Search
CPC ..... B65H 19/12; B65H 19/30; B65H 75/10; B65H 75/24; B65H 75/2437; B65H 2701/514
See application file for complete search history.

(56) References Cited

U.S. PATENT DOCUMENTS 2,656,990 A 10/1953 Radtke
4,802,637 A * 2/1989 Williams ..... B65H 75/245 242/597.5

(Continued)

FOREIGN PATENT DOCUMENTS

FR 1103912 A 11/1955
FR 1145624 A 10/1957
FR 1166667 A 11/1958

OTHER PUBLICATIONS

International Preliminary Report on Patentability for PCT Application No. PCT/EP2019/063511 mailed Dec. 30, 2020, 9 pages.

*Primary Examiner* — Sang K Kim
(74) *Attorney, Agent, or Firm* — Peter W. Schroen; Bret E. Field; Bozicevic, Field & Francis LLP

(57) ABSTRACT

The invention describes a sleeve for sliding onto and removing from a winding shaft, which comprises a one-piece workpiece defining a cylinder, which workpiece comprises two edge regions each having an edge, the edge regions overlapping one another, the sleeve having a first diameter in a relaxed state, the sleeve in a clamped state having a second diameter which is different from the first diameter, the sleeve in the clamped state experiencing an elastic deformation as compared to the relaxed state.

8 Claims, 3 Drawing Sheets

Figure 5:
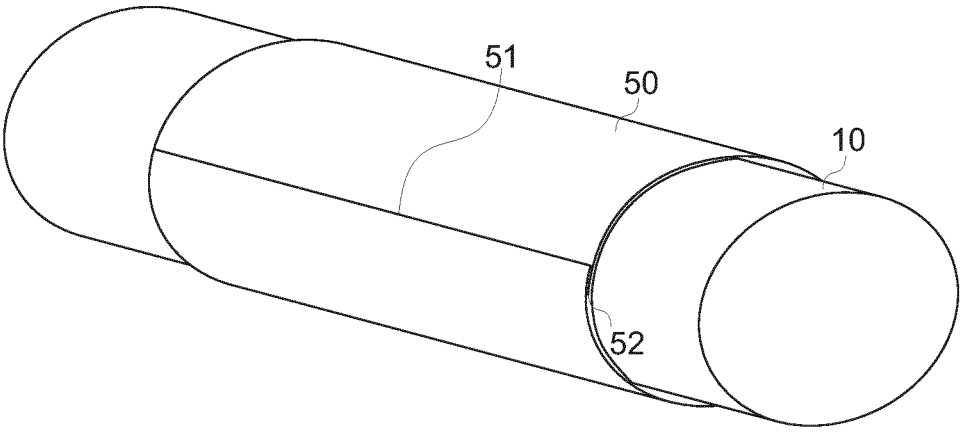

(52) U.S. Cl.
CPC ..... *B65H 2301/414* (2013.01); *B65H 2301/41828* (2013.01); *B65H 2701/514* (2013.01)

(56) References Cited

U.S. PATENT DOCUMENTS

| | | | | |
|---|---|---|---|---|
| 4,832,276 | A * | 5/1989 | Gebhardt | B65H 75/10 242/573.7 |
| 6,036,139 | A * | 3/2000 | Ogg | B65H 75/10 138/144 |
| 9,561,929 | B2 * | 2/2017 | Mellin | A47K 10/16 |
| 9,756,991 | B2 * | 9/2017 | Mellin | B31C 3/00 |
| 2004/0052987 | A1 * | 3/2004 | Shetty | B32B 27/34 156/203 |
| 2008/0135672 | A1 * | 6/2008 | Fabian | B65H 75/24 242/571 |
| 2013/0186997 | A1 | 7/2013 | Martinez et al. | |
| 2013/0341456 | A1 * | 12/2013 | Pellengo Gatti | B65H 19/2276 242/581 |

* cited by examiner

Fig. 1: Prior Art
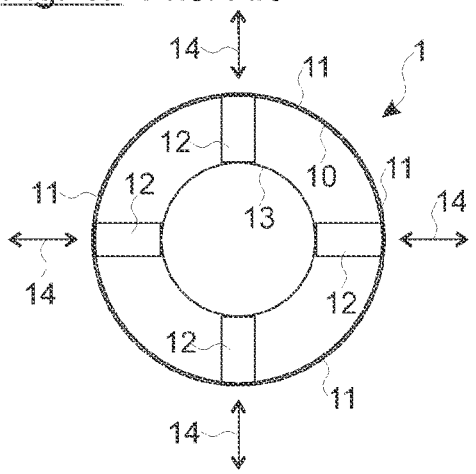
Fig. 2: Prior Art
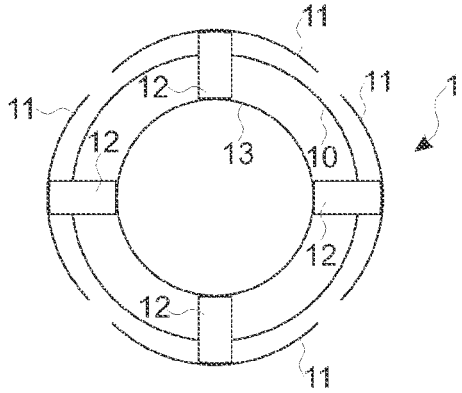
Fig. 3:
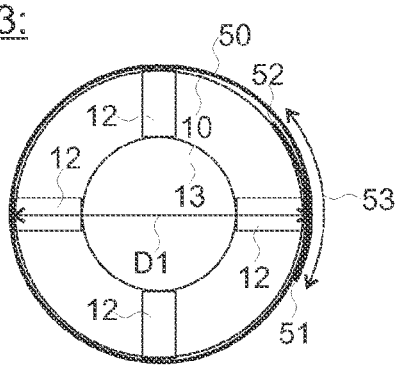
Fig. 4:
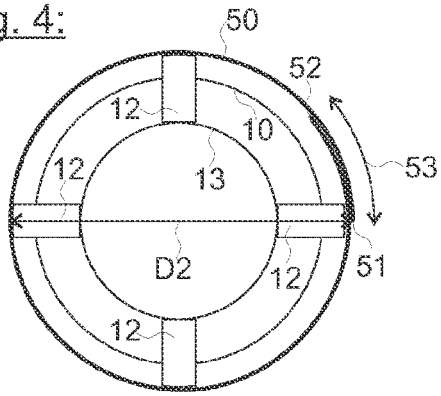

SLEEVE, WINDING DEVICE, AND METHOD FOR REPEATED, SUCCESSIVE WINDING OF WEBS TO FORM REELS OF MATERIAL

The invention relates to a sleeve for repeated, successive winding of webs to form reels of material as well as a winding apparatus which comprises such sleeve.

The prior art consists of winding foil and webs onto winding sleeves, wherein these webs remain on the winding sleeve for further transport and further processing. These can be made of cardboard, plastic or metal, cardboard being the most common case of application. In order to reduce material costs and waist, there are approaches to wind without any sleeves (coreless). In doing so, the material is wound directly onto the winding shaft which can be reduced in its outer diameter after finishing the winding process. At the moment of reducing, the innermost layers of the reel take over the load-bearing function of the sleeve. Winding shafts known in the prior art generally have the implementation represented below.

For these winding shafts, three or more jackets are arranged on the circumference. These can be increased in diameter by pumping up an air tube in the interior of the winding shaft core to a larger diameter. In this state, the foil is being wound. After the winding process has been finished, air is being let out and the jackets retreat to their original smaller diameter by means of spring force. In this state, the inner layers of the foil carry the foil reels and a gap toward the winding shaft is created. In consequence, the finished reel can be removed from the winding shaft.

This solution, however, has two disadvantages. The clamping elements are heavy and significantly reduce the load-bearing cross section of the winding shaft. This means small work widths and/or low facility speeds, particularly for 2-inch applications (2 inches being the outer diameter of the winding sleeves).

The second disadvantage is the gaps, which result between the jackets during expansion of the winding shaft, which is where the foil is being depressed during winding. This complicates the reducing of the jackets after winding, which reduces process security of the removing process. Furthermore, the impressions by the gaps in the inside of the reel can be seen, which is a negative quality designation.

Furthermore, coreless winding shafts are known, which consist of a pipe with many bores, which is where, after winding onto the pipe, an air cushion is built up by means of air pressure between pipe and reel, which facilitates the removing process. This method, however, does not work very process-reliably.

It is therefore the object of the present invention to suggest an arrangement and a winding apparatus as well as a method, in which the above mentioned disadvantages are eliminated or at least reduced.

This object is solved according to the invention by features of the present disclosure.

The concept is based on a standard winding shaft for conventional winding sleeves, which, however, can be refitted to a coreless winding shaft by sliding on a sleeve according to the invention and/or can be used without any refitting. Preferably, the standard winding shaft comprises control elements, which can be displaced with respect to the winding shaft, wherein one component of the displacement faces radially outwards. In order to facilitate a displacement, the control elements can be driven, wherein a pressure chamber and/or a flexible tube are preferably provided within the winding shaft. A pressure chamber can be filled, for example, with a fluid, which is pressurized for the purpose of displacing the control elements. A flexible tube can be inflated in an easy manner, that is it can be applied with a larger fluid volume.

By means of the sliding onto and affixing of a very thin-walled helical sleeve, this shaft becomes a coreless winding shaft. This sleeve consists of a one-piece, cylinder-shaped cover, which comprises two edge regions, which overlap by forming an overlapping area. In the resting position, this sleeve preferably has an inner diameter, which is smaller, equal to or only minimally larger (max. 5 mm) than the outer diameter of the winding shaft. This results in an almost circular surface which can be brought into different diameters by clamping and relaxing. In doing so, the sleeve has a first diameter in the relaxed state. If the control elements are now moved outwards—by means of a radial movement component—the sleeve is transitioned into a clamped state, wherein the overlapping area decreases. This can also be seen as the mutual shortest distance of the two edges decreasing. In the clamped state, the sleeve has a second diameter, wherein this second diameter deviates from the first diameter. In particular, the second diameter is larger than the first diameter.

In this case, the material is elastic, i.e., it returns to its original position after relaxing and reassumes its original geometry.

In order to have sufficient pretension on the winding shaft, a sleeve according to the invention can have an internal diameter, which is smaller than the outer diameter of the winding shaft. The inner diameter of the sleeve can, e.g., be 10%, preferably up to 5%, smaller than the outer diameter of the winding shaft. The inner diameter of the sleeve is meant to be that diameter, which the sleeve assumes if it is not slid onto the winding shaft. Such inner diameter ensures that the sleeve also returns from the clamped state to the relaxed state.

Path limiters and/or force limiters can act on the control elements within the winding shaft, wherein the path limiters and/or force limiters can be particularly set. In this manner, the path of the control elements can be limited in the radial direction outwards, so that the second diameter assumes a desired value. In conventional winding sleeves, such path limiters and/or force limiters are not required, as a sleeve known from prior art already limits the path or the force by means of its stability.

A significant advantage of the invention is the fact that by means of a winding shaft, winding is possible both with and without conventional winding sleeves. Only the sleeve according to the invention must be slid on. This reduces refitting times and high initial costs due to two complete winding shafts.

A further, very important advantage of the invention is the non-presence of gaps in the clamped state. This results in an essentially round interior of the reel of material which is a quality feature for the sale of the reel of material.

An advantageous embodiment of the invention provides that the edges of the sleeve extend in parallel to the main axis of inertia of the sleeve. In this case, the edges extend in parallel to the axis of rotation of the winding shaft, if the sleeve is slid onto it. Preferably, the sleeve is applied to the winding shaft in a way, that the edge abutting in the area of the overlap is positioned at the rear end of the sleeve, seen in the direction of rotation of the winding shaft. In this case, the front end of the material web can be applied behind the advancing edge of the sleeve, if said web is rewound. Thus, the batch that is created after every rotation of the winding shaft, if the material web meets the beginning of the web, can be reduced so that a uniform reel is created. This is advantageous even for thin material webs.

In another advantageous embodiment, the edges extend at an angle to the main axis of inertia of the sleeve, in particular helically. By means of such embodiment, an imbalance of the sleeve can be reduced or even completely avoided.

It is further advantageous, when the material of the sleeve comprises carbon fiber reinforced plastic (CFK). In particular, the sleeve can be completely fabricated from this material. A sleeve comprising CFK can be very thin-walled. In consequence, imbalances of the winding shaft equipped with the sleeve are avoided, the winding shaft thus running smoothly, which is advantageous, in particular for high winding speeds. The high stability of this material also effects that the outer circumference maintains a very good circular form when enlarging the diameter which has a positive effect on the quality of the reel.

An alternative or additional embodiment of the invention provides that the material of the sleeve comprises at least in part steel, in particular spring steel. Very reasonable sleeves can be manufactured with this material.

The above mentioned object is also solved by a winding apparatus and a sleeve for successively winding of material web sections to form reels of material, wherein the reels of material have direct contact to the sleeve, wherein the reels of material are displaceable relative to the sleeve, wherein the sleeve remains in a fixed position during displacing of the reel of material relative to the winding core, wherein the sleeve is configured according to any one or more of the above described exemplary embodiments according to the invention.

Further, the above mentioned object is solved by a method for successively winding of material web sections to form reels of material, wherein

- a sleeve is being or is arranged on a winding core while the sleeve is present in a relaxed state with a first diameter,
- the sleeve is transitioned into a clamped state with a second diameter, wherein the second diameter is larger than the first diameter,
- the material web section is wound onto the sleeve to form the reel of material,
- the sleeve is again transitioned into the relaxed state,
- the reel of material is removed from the sleeve, wherein the method is characterized in that the sleeve comprises a one-piece workpiece defining a cylinder, which comprises two edge regions with one edge respectively, wherein the edge regions overlap one another, wherein during transitioning of the sleeve from the relaxed state to the clamped state the distance of the edges is decreased.

By means of this method the same advantages are achieved as they are with a winding apparatus according to the invention and/or a sleeve according to the invention. In this method, the sleeve can remain on the winding core or also be removed together with the finished reel of material.

Further advantages, features, and details of the invention follow from the below description, in which several exemplary embodiments are explained in detail with reference to the drawings. In doing so, the features mentioned in the claims and in the description can be essential to the invention individually by themselves or in any desired combination. Within the scope of the entire disclosure, the features and details which are described in connection with the sleeve according to the invention obviously also apply in connection to the method and/or the apparatus according to the invention and vice versa, respectively, so that individual aspects of the invention can be or are referenced mutually reciprocal with respect to the disclosure. The individual Figures show in:

FIG. 1 a coreless winding shaft according to the prior art

FIG. 2 as in FIG. 1, but with control elements displaced outwards

FIG. 3 cross section of a winding shaft with a sleeve according to the invention in the relaxed state FIG. 4 as in FIG. 3, but in the clamped state FIG. 5 perspective illustration of the essential components of FIG. 3

Figure 6:
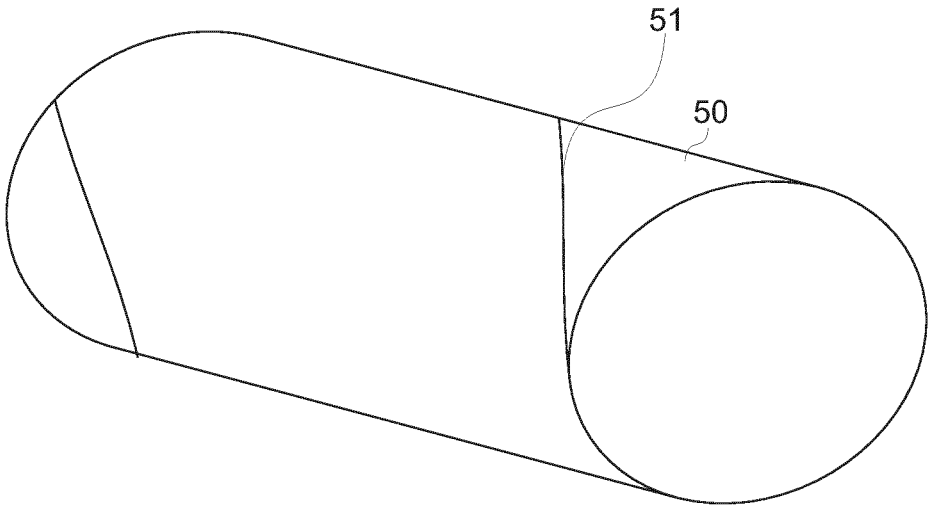
Figure 7:
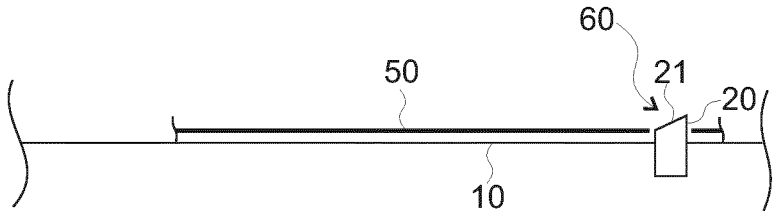
Figure 8:
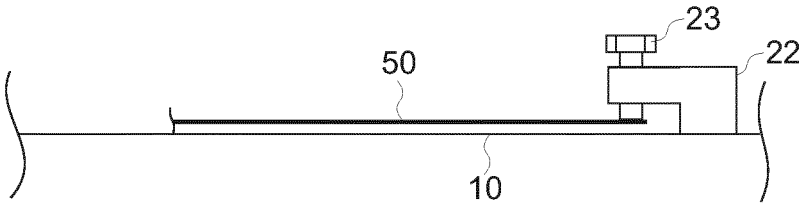
Figure 9:
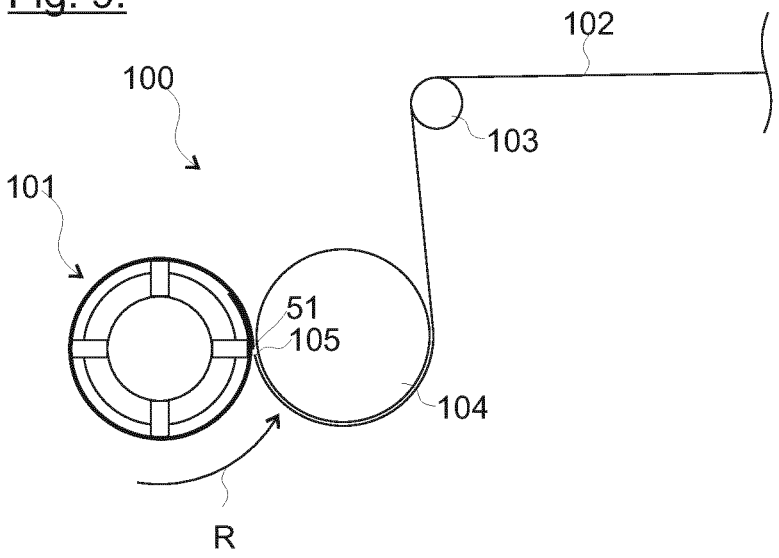

FIG. 6 perspective illustration of a further embodiment of a sleeve according to the invention FIG. 7 an embodiment example of a winding shaft arrangement provided with a fixating element FIG. 8 an embodiment example of a winding shaft arrangement provided with another fixating element FIG. 9 a winding device according to the invention FIG. 1 shows a cross section through a so-called coreless winding shaft 1 according to the prior art. The actual winding shaft can be discerned, which comprises a load-bearing pipe 10. The load-bearing pipe 10 is surrounded by a plurality of jacket parts 11, which in their entirety surround the pipe 10 preferably concentrically and, in the relaxed state, can abut on its outer diameter. Via control elements 12, of which at least one is associated to each jacket part 11, the jacket parts 11 can be displaced in radial direction of the load-bearing pipe 10. In order to be able to displace the control elements in a uniform manner and simultaneously, at least one force provision device is provided which is formed as an expanding cavity, for example a hose 13, in the present FIG. 1. By pouring in a pressurized fluid, preferably air, this cavity can be expanded in the radial direction thus pressing the control elements outwards, which is clarified by arrows 14. The state, into which the control elements are displaced outwards is represented in FIG. 2.

FIG. 3 shows a first embodiment of a sleeve 50 according to the invention in a cross-sectional view. Said sleeve can be slid onto a winding shaft, which also comprises a load-bearing pipe 10. Within the load-bearing pipe 10, control elements 12 and an expanding cavity 13 are also provided, the structure and function of which are analogously to the prior art. Features which were described in connection with FIGS. 1 and 2 can therefore be combinable with features which are described in connection with FIGS. 3 to 6 or are shown by means of these Figures. The sleeve extends in the circumferential direction around the load-bearing pipe 10, wherein the sleeve is at an angle of more than 360°. In other words, the edge 51 of the sleeve abuts on the outer circumference of the sleeve 50 and the edge 52 of the sleeve abuts on the inner circumference of the sleeve 52. Put yet another way, the sleeve 50 overlaps itself in an overlapping area which is represented by the double arrow 53. In this relaxed state, in which the sleeve 50 can have touching contact with the load-bearing pipe 10, the sleeve 50 has a first diameter D1, wherein it is to be noted that due to the overlap the sleeve does not have an ideal round cross section.

FIG. 4 shows the arrangement of FIG. 3, however with control elements 12 displaced outwards in radial direction of the load-bearing pipe 10. The displacing of the control elements, in turn, proceeds as in the prior art. During displacement of the control elements, the parts of the sleeve, which lay on top of another in the overlapping area, move relative to one another. In other words, the edges 51 and 52 approach each other, or, put another way, the overlapping area 53 is or is being decreased. In this clamped state, the sleeve 50 has a diameter D2, which is larger than diameter D1.

Upon reaching the clamped state, the winding process can start, and a reel of material can be formed from the sleeve 50. If a reel of material has been finished and now has to be removed from the sleeve, the sleeve 50 has to be transitioned again into the relaxed state according to FIG. 3, in which diameter D1 of sleeve 50 now is smaller than the inner diameter of the reel of material.

FIG. 5 shows a perspective illustration of a load-bearing pipe 10 and of the sleeve 50 slid onto it. It can be discerned that the edge 51 extends in parallel of the main axis of inertia of the sleeve 51, which extends near or on the axis of rotation of the winding shaft and thus the load-bearing pipe 10.

FIG. 6 shows another embodiment of a sleeve 50 according to the invention. The illustration is also perspective. In deviation from the embodiment according to FIG. 5, the edge 51 (and thus also the edge 52, which is not shown) does not extend in parallel, but at an angle to the main axis of inertia of the sleeve 50. In other words, the edge 51 extends helically. Preferably, the circumferential angle of edge 51 is more than 360°. Also present but not shown in this embodiment is an overlapping area. The characteristics according to which the edges approach one another or the overlapping area decreases to transition the sleeve from a relaxed state into a clamped state, also remain.

In order to avoid an axial displacement of the sleeve 50 relative to the load-bearing pipe 10, at least one fixating element can be provided in an advantageous embodiment which element decreases said displacement or even prevents it. This is of particular importance if a finished reel of material is to be removed from the sleeve. In doing so, the possibility exists that the sleeve is displaced inadvertently. For an automatic change of reels this would require an additional engagement in order to fittingly place the sleeve again. FIG. 7 shows a first embodiment which provides a pin 20 arranged at the load-bearing sleeve, wherein the pin represents the fixation element. In doing so, the sleeve 50 has a complementary hole 60, into which the pin can engage. In order to facilitate a sliding onto the sleeve 50, pin 20 can comprise a feeder slope 21 or be movably arranged at the load-bearing pipe. In the embodiment according to FIG. 8, a ring 22 is provided which can be slid onto the load-bearing pipe and fixated there. Said ring can now carry the fixating element. Such a ring can also be part of a fixating element. The advantage of this embodiment is that the ring can also be removed again, so that the winding shaft can be used with conventional winding sleeves which remain connected to the reel of material after winding. In the present embodiment, the fixating element can be designed as a screw 23 with which the sleeve can be pressed against the load-bearing pipe.

A sleeve according to the invention and a winding shaft explained within the scope of this description, together can form a winding shaft arrangement according to the invention.

FIG. 9 shows a winding device 100 according to the invention, which comprises a winding shaft arrangement 101 according to the invention. Via at least one master drum 103 a material web 102, which is for example a plastic web, can be fed to a contact drum 104. It is preferred if the material web 102 can be pressed against the winding shaft arrangement by means of the contact drum. The winding device is structured and operated in a way that the winding shaft arrangement rotates in the direction R. If a new beginning 105 of a material web 102 is fed to form a new reel, it is advantageous if the beginning 105 seen in direction R is applied to the sleeve shortly behind edge 51. By "shortly" is meant an angular area of 0 to maximal 30 degrees. In this manner, pitch 51, which results from edge 51 but also the pitch which results from the beginning 105, is decreased.

The invention claimed is:

1. A sleeve for sliding onto and removing from a winding shaft, which comprises a one-piece work piece defining a cylinder, which comprises two edge regions with one edge, respectively, wherein the edge regions overlap one another, wherein the sleeve has a first diameter in a relaxed state, wherein the sleeve has a second diameter in a clamped state, which deviates from the first diameter, and wherein the sleeve experiences an elastic deformation in the clamped state compared to the relaxed state.

2. The sleeve according to claim 1, characterized in that the edges run in parallel to the main axis of inertia of the sleeve.

3. The sleeve according to claim 1, characterized in that the edges run helically to the main axis of inertia of the sleeve.

4. The sleeve according to claim 1, characterized in that the material of the sleeve comprises carbon fiber reinforced plastic.

5. The sleeve according to claim 1, characterized in that the material of the sleeve comprises at least in part steel.

6. The sleeve according to claim 5, characterized in that the material of the sleeve comprises at least in part spring steel.

7. A winding device with a winding core and a sleeve for successively winding of material web sections to form reels of material, wherein the reels of material have direct contact with the sleeve, wherein the material webs are displaceable relative to the sleeve, and wherein the sleeve remains in a fixed position during the displacing of the reel of material relative to the winding core, characterized by a sleeve according to claim 1.

8. A method for successively winding of material web sections to form reels of material, wherein sleeve is being or is arranged on a winding core while the sleeve is in a relaxed state with a first diameter, the sleeve is transitioned into a clamped state having a second diameter, wherein the second diameter is larger than the first diameter, the material web section is wound onto the sleeve to form the reel of material, the sleeve is transitioned into the relaxed state, again, and the material web is removed from the sleeve, characterized in that the sleeve comprises a one-piece work piece defining a cylinder, which comprises two edge regions with one edge, respectively, wherein the edge regions overlap each other, wherein during transitioning of the sleeve from the relaxed state to the clamped state, the distance of the edges is reduced.

* * * * *